US010358611B2

(12) United States Patent
Gonzalez Lippke et al.

(10) Patent No.: US 10,358,611 B2
(45) Date of Patent: Jul. 23, 2019

(54) STAGED HYDROTREATING AND HYDROCRACKING PROCESS AND APPARATUS

(71) Applicant: UOP LLC, Des Plaines, IL (US)

(72) Inventors: Gabriela M. Gonzalez Lippke, Surbiton (GB); Simerjeet Singh, Windsor (GB); Richard K. Hoehn, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/424,096

(22) Filed: Feb. 3, 2017

(65) Prior Publication Data

US 2018/0223198 A1 Aug. 9, 2018

(51) Int. Cl.
*C10G 67/02* (2006.01)

(52) U.S. Cl.
CPC ..... *C10G 67/02* (2013.01); *C10G 2300/202* (2013.01)

(58) Field of Classification Search
CPC ..... C10G 67/02; C10G 2300/202
See application file for complete search history.

(56) References Cited

U.S. PATENT DOCUMENTS 3,130,006 A 4/1964 Rabo et al.
4,058,449 A 11/1977 Reitz et al.
7,449,102 B2 11/2008 Kalnes
7,686,941 B2 3/2010 Brierley et al.
7,803,334 B1 9/2010 Hoehn et al.
9,752,085 B2 9/2017 Zimmerman et al.
2009/0095654 A1 4/2009 Gupta et al.
2010/0043279 A1* 2/2010 Abhari ..... C10G 45/02 44/308
2014/0374311 A1* 12/2014 Zimmerman ..... C10L 1/08 208/58
2015/0132196 A1* 5/2015 Zimmerman ..... B01J 19/24 422/187

FOREIGN PATENT DOCUMENTS

DE 10247780 B4 6/2015

OTHER PUBLICATIONS

Search Report dated Jun. 7, 2018 for corresponding PCT Appl. No. PCT/US2018/016086.

* cited by examiner

*Primary Examiner* — Randy Boyer
*Assistant Examiner* — Juan C Valencia
(74) *Attorney, Agent, or Firm* — Paschall & Maas Law Office LLC; James C. Paschall

(57) ABSTRACT

An apparatus and process is disclosed for hydrocracking a hydrocarbon feed stream following hydrotreating the feed stream. A separator removes diesel and lower boiling materials in a hydrotreated stream before a hydrocracking reactor, so only liquid materials heavier than diesel are hydrocracked in a hydrocracking reactor. A vapor hydrotreated stream and the hydrocracked stream are separated and fractionated together.

14 Claims, 1 Drawing Sheet

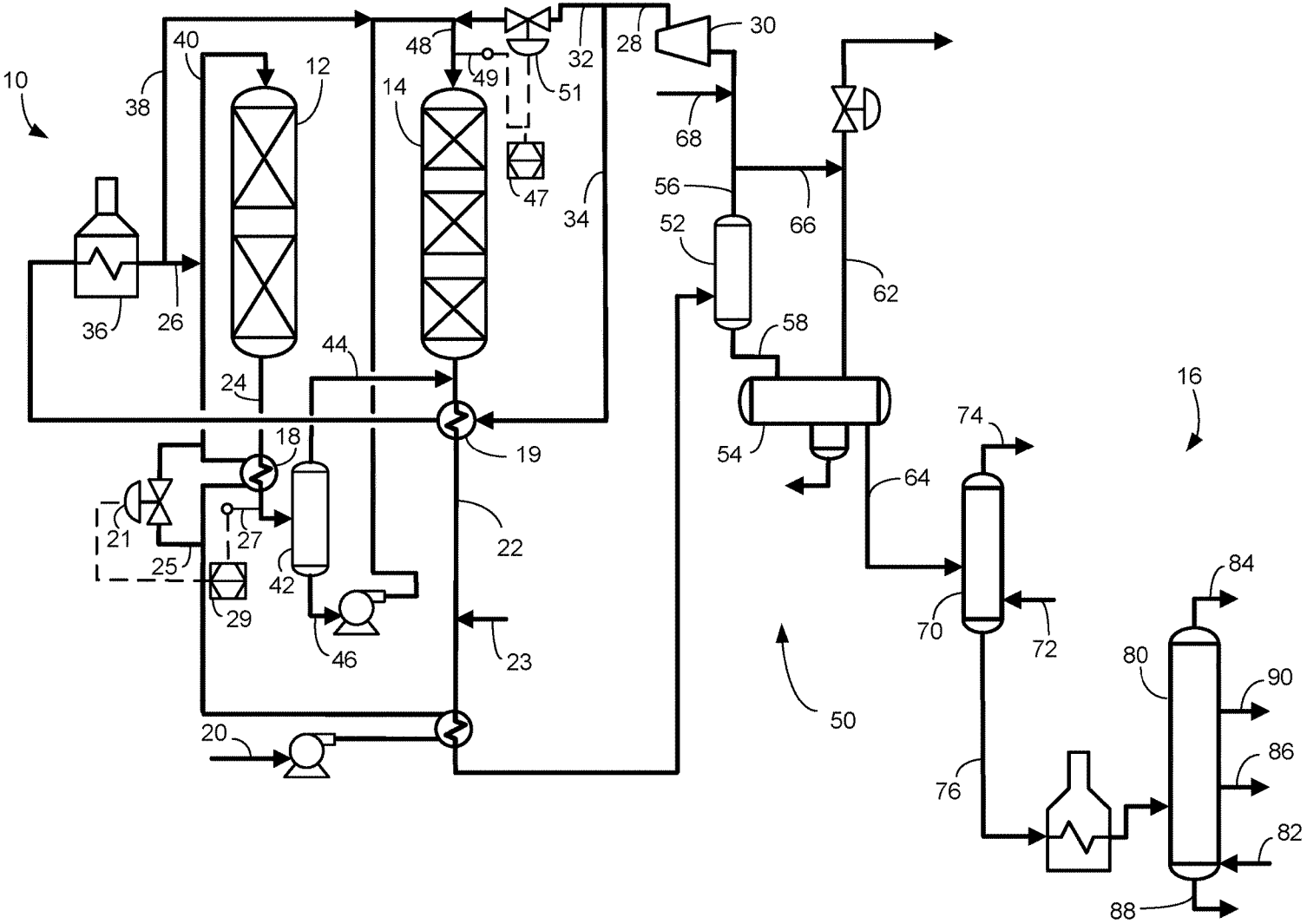
10
12
14
16
18
19
20
21
22
23
24
25
26
27
28
29
30
32
34
36
38
40
42
44
46
47
48
49
50
51
52
54
56
58
62
64
66
68
70
72
74
76
80
82
84
86
88
90

STAGED HYDROTREATING AND HYDROCRACKING PROCESS AND APPARATUS

FIELD

The field of the subject matter is hydrocracking.

BACKGROUND

Hydroprocessing can include processes which convert hydrocarbons in the presence of hydroprocessing catalyst and hydrogen to more valuable products.

Hydrotreating is a hydroprocessing process used to remove heteroatoms such as sulfur and nitrogen from hydrocarbon streams to meet fuel specifications and to saturate olefinic or aromatic compounds. Hydrotreating can be performed at high or low pressures, but is typically operated at lower pressure than hydrocracking.

Hydrocracking includes processes which convert hydrocarbons in the presence of hydrocracking catalyst and hydrogen to more valuable products. Hydrocracking is a hydrocracking process in which hydrocarbons crack in the presence of hydrogen and hydrocracking catalyst to lower molecular weight hydrocarbons. Depending on the desired output, the hydrocracking reactor may contain one or more beds of the same or different catalyst. Hydrocracking is a process used to crack hydrocarbon feeds such as vacuum gas oil (VGO) to diesel including kerosene and gasoline motor fuels.

Hydrocarbon feed to a hydrocracking unit can be pretreated with hydrotreating catalyst to remove heteroatoms from the hydrocarbon molecules and to saturate aromatics. Hydrocarbon feed streams to hydrocracking units can often contain significant proportions of desired product such as diesel. If precautions are not taken, the diesel can be hydrocracked to naphtha which may not be desired by the refiner.

There is a need, therefore, for improved processes and apparatuses that preserve diesel in the hydrocracking unit.

BRIEF SUMMARY

We propose to separate gas comprising diesel and lighter materials from a hydrotreated stream, so just the liquid hydrotreated material is fed to the hydrocracking reactor. Gas removed by separation containing the hydrogen sulfide and ammonia may bypass the hydrocracking reactor leaving the hydrocracking catalyst free of these catalyst inhibiters. The diesel and lighter materials separated in a hydrotreated gas stream also removes hydrogen from the hydrocracking feed stream. Hence, a branch stream from a hydroprocessing hydrogen stream is routed around the hydrotreating reactor to supply hydrogen requirements for the hydrocracking reactor.

BRIEF DESCRIPTION OF THE DRAWING

The FIGURE is a schematic drawing of the process and apparatus.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of the reflux or reboil to the column.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5" or "T95" means the temperature at which 5 volume percent or 95 volume percent, as the case may be, respectively, of the sample boils using ASTM D-86.

As used herein, the term "initial boiling point" (IBP) means the temperature at which the sample begins to boil using ASTM D-86.

As used herein, the term "end point" (EP) means the temperature at which the sample has all boiled off using ASTM D-86.

As used herein, "vacuum gas oil" means a hydrocarbon material having an IBP of at least about 232° C. (450° F.), a T5 of about 288° C. (550° F.) and about 392° C. (700° F.), typically no more than about 343° C. (650° F.), a T95 between about 510° C. (950° F.) and about 570° C. (1058° F.) and, or an EP of no more than about 626° C. (1158° F.) prepared by vacuum fractionation of atmospheric as determined by any standard gas chromatographic simulated distillation method such as ASTM D2887, D6352 or D7169, all of which are used by the petroleum industry.

As used herein, "atmospheric residue" means a hydrocarbon material having an IBP of at least about 232° C. (450° F.), a T5 of about 288° C. (550° F.) and about 392° C. (700° F.), typically no more than about 343° C. (650° F.), and a T95 between about 510° C. (950° F.) and about 700° C. (1292° F.) obtained from the bottoms of an atmospheric crude distillation column.

As used herein, the term "diesel boiling range" means hydrocarbons boiling in the range of an IBP between about 125° C. (257° F.) and about 175° C. (347° F.) or a T5 between about 150° C. (302° F.) and about 200° C. (392° F.) and the "diesel cut point" comprising a T95 between about 343° C. (650° F.) and about 399° C. (750° F.).

As used herein, the term "diesel conversion" means conversion of feed that boils above the diesel cut point to material that boils at or below the diesel cut point in the diesel boiling range.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

DETAILED DESCRIPTION

It is proposed to separate hydrotreated effluent from a hydrotreating reactor in a hot separator and send only the hydrotreated liquid to a hydrocracking reactor wherein both the hydrotreating reactor and the hydrocracking reactor are fed from the same hydroprocessing hydrogen stream. A vapor hydrotreated stream from the hot separator, which contains the majority of hydrogen, hydrogen sulfide and ammonia and hydrocarbons as heavy as diesel bypasses the hydrocracking reactor and is further separated along with the hydrocracked stream.

The apparatus and process 10 for hydrocracking hydrocarbons comprise a hydrotreating reactor 12, a hydrocracking reactor 14 and a fractionation section 16 as shown in the FIGURE. A hydrocarbon feed stream is first fed to the hydrotreating reactor 12 which removes heteroatoms such as sulfur and nitrogen for hydrocarbon molecules and saturates olefins and some aromatics. A liquid hydrotreated stream is fed to the hydrocracking reactor 14 to convert heavier hydrocarbons into the diesel boiling range. The hydrocracking reactor 14 may be in downstream communication with a bottoms line 46 of a hot separator 42 which separates a hydrotreated effluent stream and a second hydrogen line 38 which is taken from a hydroprocessing hydrogen line 28 that feeds a first hydrogen line 26 that supplies hydrotreating hydrogen requirements.

A hydrocarbon feed stream may be introduced in a hydrocarbon feed line 20. Illustrative hydrocarbon feed stocks for the first hydrocarbon feed stream include hydrocarbonaceous streams having components boiling above about 288° C. (550° F.), such as atmospheric gas oils, vacuum gas oil (VGO), deasphalted, vacuum, and atmospheric residua, coker distillates, straight run distillates, solvent-deasphalted oils, pyrolysis-derived oils, high boiling synthetic oils, and cycle oils and the like. These hydrocarbonaceous feed stocks may contain from about 0.1 to about 4 wt-% sulfur.

The most common of such conventional hydrocarbon streams is a vacuum gas oil (VGO) prepared by vacuum fractionation of atmospheric residue. Atmospheric residue is an alternative feedstock obtained from the bottoms of an atmospheric crude distillation column. The hydrocarbon stream may comprise about 5 wt % to about 35 wt % or about 10 wt % to about 25 wt % diesel.

The hydrocarbon feed stream in the hydrocarbon feed line 20 may be heat exchanged with a hydroprocessed stream in a hydroprocessed line 22 and a hydrotreated stream in a hydrotreated effluent line 24 before it is mixed with a first hydrogen stream in a first hydrogen line 26.

The first hydrogen stream in the first hydrogen line 26 is taken from a hydroprocessing hydrogen stream in the hydroprocessing hydrogen line 28. The hydroprocessing hydrogen stream in the hydroprocessing hydrogen line 28 may be in downstream communication with a gas compressor 30, which may be a recycle gas compressor. At least three streams may be taken from the hydroprocessing hydrogen stream in the hydroprocessing hydrogen line 28. A quench stream in quench line 32 may be taken from the hydroprocessing hydrogen stream in the hydroprocessing hydrogen line 28. The quench stream is split from the hydroprocessing stream to provide a hydrogen requirement stream in a hydrogen requirement line 34. The hydrogen requirement stream in the hydrogen requirement line 34 is heat exchanged in a heat exchanger 19 with the hydroprocessed stream in the hydroprocessed line 22 to heat it and is forwarded to a heater 36 which may be a fired heater. The heater 36 is in downstream communication with the hydroprocessing hydrogen line 28 and the hydrogen requirement line 34. The first hydrogen stream in the first hydrogen line 26 and a second hydrogen stream in a second hydrogen line 38 are taken from the hydrogen requirement stream 34 which is taken from the hydroprocessing hydrogen stream in the hydroprocessing hydrogen line 28. Hence, the first hydrogen stream in the first hydrogen line 26 and a second hydrogen stream in a second hydrogen line 38 are taken from the hydroprocessing hydrogen stream in the hydroprocessing hydrogen line 28 via the hydrogen requirement stream in the hydrogen requirement line 34. The first hydrogen stream in the first hydrogen line 26 and the second hydrogen stream in the second hydrogen line 38 may be taken from the hydrogen requirement stream 34 before or after the heater 36. In other words, the split between the first hydrogen stream in the first hydrogen line 26 and the second hydrogen stream in the second hydrogen line 38 may be before or after the heater 36. For purposes of illustration, the split between the first hydrogen stream in the first hydrogen line 26 and the second hydrogen stream in the second hydrogen line 38 is taken after the heater 36 in the FIGURE. The first hydrogen line 26 and the second hydrogen line 38 may be in downstream communication with the heater 36.

The heated first hydrogen stream in the first hydrogen line 26 is mixed with the heated hydrocarbon feed stream in the hydrocarbon feed line 20 to provide a hydrotreating feed stream in hydrotreating feed line 40. In the hydrotreating reactor 12, the hydrocarbon stream in the hydrotreating feed stream is hydrotreated in the presence of the first hydrogen stream and a hydrotreating catalyst to produce a hydrotreated stream. The hydrotreating reactor 12 is in downstream communication with the first hydrogen line 26.

Hydrotreating is a process wherein hydrogen is contacted with hydrocarbon in the presence of hydrotreating catalyst which is primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics.

The hydrotreating reactor 12 may comprise a guard bed of hydrotreating catalyst followed by one or more beds of higher quality hydrotreating catalyst. The guard bed filters particulates and picks up contaminants in the hydrocarbon feed stream such as metals like nickel, vanadium, silicon and arsenic which deactivate the catalyst. The guard bed may comprise material similar to the hydrotreating catalyst. Supplemental hydrogen may be added at an interstage location between catalyst beds in the hydrotreating reactor 12.

Suitable hydrotreating catalysts for use in the hydrotreating reactor 12 are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts. In the high sulfur and nitrogen environment of the hydrotreating reactor 12, noble metal catalysts would be discouraged. More than one type of first hydrotreating catalyst may be used in the hydrotreating reactor 12. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred reaction conditions in the hydrotreating reactor 12 include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig), preferably 4.1 MPa (gauge) (600 psig) to about 20.6 MPa (gauge) (3000 psig), suitably 13.8 MPa (gauge) (2000 psig), preferably 12.4 MPa (gauge) (1800 psig), a liquid hourly space velocity of the fresh hydrocarbonaceous feedstock from about 0.1 $hr^{-1}$, suitably 0.5 $hr^{-1}$, to about 10 $hr^{-1}$, preferably from about 1.5 to about 8.5 $hr^{-1}$, and a hydrogen rate of about 168 $Nm^3/m^3$ (1,000 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

The hydrocarbon feed stream in the hydrotreating feed line 40 is hydrotreated over the hydrotreating catalyst in the hydrotreating reactor 12 to provide a hydrotreated stream that exits the hydrotreating reactor 12 in a hydrotreating effluent line 24. The hydrotreated stream may include unreacted hydrogen gas, ammonia, hydrogen sulfide, diesel boiling range product and unconverted oil. The hydrotreated stream may include about 5 wt % to about 35 wt % or about 10 wt % to about 25 wt % diesel boiling range material. If the diesel material is subjected to hydrocracking, it may be cracked down to below the diesel boiling range, thus reducing the diesel yield. Consequently, the hydrotreated stream may be separated in a hot separator 42 to separate diesel and lower boiling materials in a vapor hydrotreated stream in a hot separator overhead line 44 and unconverted oil boiling over the diesel cut point in a liquid hydrotreated stream in a hot separator bottoms line 46. The hot separator 42 is in downstream communication with the hydrotreating reactor 12. The hot separator operates at the temperature of the hydrotreating reactor 12 typically and can be cooled by heat exchange in a heat exchanger 18 with the hydrocarbon feed stream in hydrocarbon feed line 20 if the hydrotreating reactor 12 is operated at a temperature hotter than desired for the hot separator such as at the end of run for the hydrotreating catalyst when it is less active. It is desired that the hot separator be operated at about 340 to about 380° C., so to ensure over 70 wt %, suitably over 80 wt % and preferably over 90 wt % of the diesel boiling material in the hydrotreated stream in hydrotreating effluent line 24 is kept in the vapor hydrotreated stream in the hot separator overhead line 44. The vapor hydrotreated stream in the hot separator overhead line 44 is mixed with the hydrocracked stream upstream or downstream of the heat exchanger 19 to produce a hydroprocessed stream in hydroprocessed line 22. The hydroprocessed line 22 may be in downstream communication with the hydrocracking reactor 14 and an overhead line 44 of the hot separator 44. By mixing the vapor hydrotreated stream with the hydrocracked stream, a heat balance and required heater duty of an apparatus or process that does not separate the hydrotreated stream in a hot separator prior to hydrocracking is not significantly changed when revamped or modified to be an apparatus and process according to the present embodiment that employs a hot separator prior to hydrocracking.

The degree of cooling of the hydrotreated stream in the hydrotreating effluent line 24 can be moderated by a controlled bypass line 25 which bypasses some, none or all of the hydrocarbon feed stream around the heat exchanger 18 such as when the hydrotreated stream from the hydrotreating reactor 12 is at the temperature desired for operating the hot separator 42. A control valve 21 on the bypass line 25 regulates the flow rate of the hydrocarbon feed stream therethrough. A temperature indicator controller 27 may also be in communication with the hydrotreating effluent line 24. The temperature indicator controller 27 measures the temperature of the hydrotreating effluent stream to compare it to a hot separator temperature set point. The comparison may be performed by the computer 29 that receives a signal of the measured temperature from the temperature indicator controller 27. If the temperature of the hydrotreating effluent stream is greater than the set point, then the control valve 21 on the bypass line 25 is closed relatively more to decrease the flow rate of the cooler hydrocarbon feed stream through the bypass line 25, so more of the cooler the hydrocarbon feed stream is heat exchanged with the hydrotreating effluent stream in the heat exchanger 18. If the measured temperature signaled from the temperature indicator controller 27 is less than the set point, then the control valve 21 on the bypass line 25 is opened relatively more to increase the flow rate of the hydrocarbon feed stream through the bypass line 25, so less of the cooler hydrocarbon feed stream in the hydrocarbon feed line 20 is heat exchanged with the hydrotreating effluent stream in the heat exchanger 18. If the measured temperature of the hydrotreating effluent stream in hydrotreating effluent line 24 is the same as the set point, then the control valve 21 on the bypass line 25 is not adjusted.

The liquid hydrotreated stream in the hot separator bottoms line 46 is pumped to the hydrocracking reactor 14. The liquid hydrotreated stream in the hot separator bottoms line 46 may be mixed with the second hydrogen stream in the second hydrogen line 38, which bypasses the hydrotreating reactor 12, to provide a hydrocracking feed stream in a hydrocracking feed line 48. The hydrocracking feed stream is delivered in the hydrocracking feed line 48 to the hydrocracking reactor 14 to be hydrocracked. The second hydrogen stream may heat the liquid hydrotreated stream to a higher temperature than required for the hydrocracking reactor 14. Optionally, the quench hydrogen stream in quench hydrogen line 32 taken from the hydroprocessing hydrogen stream in the hydroprocessing hydrogen line 28 before it is heated may be combined with the second hydrogen stream before or after mixing with the liquid hydrotreated stream in the hot separator bottoms line 46 to quench the second hydrogen stream and lower the hydrocracking feed stream to the desired hydrocracking reaction temperature. The hydrocracking feed line 48 may be in downstream communication with the bottoms line 46 of the hot separator 42, the second hydrogen line 38 and the cold separator 52. The hydrocracking reactor 14 may be in downstream communication with the hydrocracking feed line 48.

A control valve 51 on the quench hydrogen line 32 regulates the flow rate of the quench hydrogen stream therethrough. A temperature indicator controller 49 may also be in communication with the hydrocracking feed line 48.

The temperature indicator controller 49 measures the temperature of the hydrocracking feed stream comprising the first hydrogen stream and the quench hydrogen stream mixed with the liquid hydrotreated stream to compare it to the hydrocracking temperature set point. The comparison may be performed by the computer 47 that receives a signal of the measured temperature from the temperature indicator controller 49. If the temperature of the hydrocracking feed stream is greater than the set point, then a control valve 51 on the quench hydrogen line 32 is opened relatively more to increase the flow rate of the quench hydrogen stream to the hydrocracking feed stream. If the temperature is less than the set point, then the control valve 51 on the quench hydrogen line 32 is closed relatively more to decrease the flow rate of the quench hydrogen stream to the hydrocracking feed stream. If the temperature of the hydrocracking feed stream is the same as the set point, then the control valve 51 on the quench hydrogen line 32 is not adjusted.

The hydrocracking feed stream comprising the liquid hydrotreated stream is introduced into the hydrocracking catalyst beds comprising hydrocracking catalyst. The liquid hydrotreated stream is hydrocracked in the presence of the second hydrogen stream, the quench hydrogen stream if present and the hydrocracking catalyst in the hydrocracking reactor 14 to provide the hydrocracked stream. The hydrocracked stream is removed from the hydrocracking reactor 14. The hydrocracking feed stream in the hydrocracking feed line 48 is devoid of hydrogen sulfide and ammonia generated by hydrodesulfurization and hydrodenitrogenation in the hydrotreating reactor 12 because they are removed in the vapor hydrotreated stream 44 which bypasses the hydrocracking reactor in the hot separator overhead line 44. Consequently, the hydrogen sulfide and ammonia will not poison the hydrocracking catalyst in the hydrocracking reactor 14. Additionally, diesel boiling range materials in the hydrocarbon feed stream 20 will be hydrotreated in the hydrotreating reactor 12 but bypass the hydrocracking reactor 14 to preserve the diesel yield against further cracking to naphtha and gases boiling lower than the diesel boiling range and allowing the capacity of the hydrocracking reactor 14 to be smaller.

In some aspects, the hydrocracking reactor 14 may each provide total conversion of at least about 20 vol-% and typically greater than about 60 vol-% of the hydrocarbon feed to products boiling below the diesel cut point. The hydrocracking reactor 14 may operate at partial conversion of more than about 50 vol-% or full conversion of at least about 90 vol-% of the feed based on total conversion.

Hydrocracking may be performed in the hydrocracking reactor 14 with hydrocracking catalysts that utilize amorphous silica-alumina bases or low-level zeolite bases combined with one or more Group VIII or Group VIB metal hydrogenating components. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt-%. Platinum group metals may be used in the second hydrocracking reactor because the ammonia and hydrogen sulfide have been removed from first liquid hydrocracking effluent and the second hydrocracking stream.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° (700° F.) to about 648° C. (1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

The hydrocracking conditions in the hydrocracking reactor 14 may include a temperature from about 290° C. (550° F.) to about 468° C. (875° F.), preferably 343° C. (650° F.) to about 435° C. (815° F.), a pressure from about 4.8 MPa (700 psig) to about 20.7 MPa (3000 psig), a liquid hourly space velocity (LHSV) from about 0.3 to less than about 2.5 $hr^{-1}$ and a hydrogen rate of about 421 (2,500 scf/bbl) to about 2,527 $Nm^3/m^3$ oil (15,000 scf/bbl). Supplemental hydrogen may be added at an interstage location between catalyst beds in the hydrocracking reactor 14.

A hydrocracked stream exits the hydrocracking reactor 14 and is mixed with the vapor hydrotreated stream in the hot separator overhead line 44 to provide a hydroprocessed stream in the hydroprocessed line 22. The hydroprocessed stream, is heat exchanged with the hydroprocessing hydrogen stream in line 34 in heat exchanger 19 and with the hydrocarbon feed stream in the hydrocarbon feed line 20.

The hydroprocessed stream may be introduced into a series 50 of separators to be separated into a vapor hydroprocessed stream and a liquid hydroprocessed stream. The series 50 of separators may include a hot separator and a hot flash drum, but in the illustrated embodiment only a cold separator 52 and a cold flash drum 54 are employed. To prevent deposition of ammonium bisulfide or ammonium chloride salts in the hydroprocessed line 22 transporting the hydroprocessed stream, a suitable amount of wash water may be introduced into line 22 by line 23.

The cold separator 52 is in downstream communication with the hydrocracking reactor 14 and the hydroprocessed line 22 and separates the hydroprocessed stream to provide the vapor hydroprocessed stream in a cold separator overhead line 56 and a liquid separator stream in a cold separator bottoms line 58. The cold separator may be operated at about 46° C. (115° F.) to about 63° C. (145° F.) and just below the pressure of the hydrocracking reactor 14 accounting for pressure drop to keep hydrogen and light gases in the overhead and normally liquid hydrocarbons in the bottoms. The cold separator 52 also has a boot for collecting an aqueous phase of water added to wash out salts. The cold separator 52 serves to separate hydrogen in the vapor hydroprocessed stream for recycle to the hydrotreating reactor 12 and the hydrocracking reactor 14 in the cold separator overhead line 56. The vapor hydroprocessed stream in the cold separator overhead line 56 may be purged through purge line 66, supplemented with a make-up hydrogen stream in make-up line 68, and compressed in compressor 30 to provide the hydroprocessing hydrogen stream in the hydroprocessing hydrogen line 28. The vapor hydroprocessed stream in the cold separator overhead line 56 may be scrubbed to remove acid gases before it is supplemented with make-up hydrogen in line 68, compressed and recycled. The hydroprocessing hydrogen line 28 may be in downstream communication with the cold separator 52 via the cold separator overhead line 56.

In a further aspect, the liquid separator stream in the cold bottoms line 58 may be transported to the cold flash drum 54. The cold flash drum 54 may be any separator that splits the liquid separator stream into a vapor cold flash stream in a cold flash overhead line 62 and a liquid hydroprocessed stream in a cold flash bottoms line 64. The vapor cold flash stream in the cold flash overhead line 62 may include hydrogen and can be mixed with the vapor hydroprocessed stream purged in line 66 and sent to a downstream hydrogen recovery unit. The cold flash drum 54 also has a boot for collecting an aqueous phase of water added to wash out salts. The cold flash drum may be operated at the same temperature as the cold separator 52 but typically at a lower pressure of between about 1.4 MPa (gauge) (200 psig) and about 7.0 MPa (gauge) (1000 psig) and preferably between about 1.7 MPa (gauge) (250 psig) and about 3.4 MPa (gauge) (500 psig). The hydroprocessed liquid in the cold separator bottoms line 64 may be fractionated in the fractionation section 16.

The fractionation section 16 may include a stripping column 70 and a fractionation column 80. The liquid hydroprocessed stream in the cold flash bottoms line 64 may be heated and fed to the stripping column 70. The liquid hydroprocessed stream may be stripped with an inert gas such as steam from line 72 to provide a light ends stream of hydrogen, hydrogen sulfide, steam and other gases in an overhead line 74. A portion of the light ends stream may be condensed and refluxed to the stripper column 70. The stripping column 70 may be operated with a bottoms temperature between about 232° (450° F.) and about 315° C. (600° F.) and an overhead pressure of about 345 kPa (gauge) (50 psig) to about 1380 kPa (gauge) (200 psig). A stripped hydroprocessed stream in a stripper bottoms line 76 may be heated in a fired heater and fed to the fractionation column 80. Consequently, the fractionation column 80 is in downstream communication with the cold flash bottoms line 64, the hydrocracking reactor 14 and the overhead line 44 of the hot separator 42.

The stripped liquid hydroprocessed stream in the stripper bottoms line 76 is fractionated in the fractionation column 80 to provide several streams. The fractionation column 80 may operate with heat input from an inert gas stream such as steam from line 82 to provide an overhead naphtha stream in line 84, a diesel stream carried in line 86 from a side cut outlet and an unconverted oil stream in a bottoms line 88 which may be recycled to the hydrocracking reactor 14. The overhead naphtha stream in line 84 may require further processing such as by catalytic reforming before blending in the gasoline pool. It is also contemplated that a further side cut providing a separate light diesel stream or kerosene stream may be taken above a heavy diesel stream which then would be taken in a kerosene line 90. The fractionation column 80 is in downstream communication with the hydrotreating reactor 12 and the hydrocracking reactor 14. Consequently, at least a portion of the hydroprocessed stream may be fractionated to provide the diesel stream in the diesel line 86 and an unconverted oil stream in the bottoms line 88.

A portion of the overhead naphtha stream in line 84 may be condensed and refluxed to the fractionation column 80. The fractionation column 80 may be operated with a bottoms temperature between about 288° C. (550° F.) and about 385° C. (725° F.), preferably between about 315° C. (600° F.) and about 357° C. (675° F.) and at or near atmospheric pressure and specifically between about 25 kPa (absolute) (3 psia) and about 240 kPa (absolute) (35 psia). A portion of the fractionated bottoms may be reboiled and returned to the fractionation column 80 instead of using steam stripping.

The diesel stream has an end point equivalent to the diesel cut point. The diesel stream in line 86 is reduced in sulfur content and may meet a low sulfur diesel (LSD) specification which is less than 100 wppm sulfur or an ULSD specification which is less than 10 wppm sulfur, and/or other specifications.

SPECIFIC EMBODIMENTS

While the following is described in conjunction with specific embodiments, it will be understood that this description is intended to illustrate and not limit the scope of the preceding description and the appended claims.

A first embodiment of the invention is a process comprising taking a hydroprocessing hydrogen stream and a second hydrogen stream from a hydroprocessing hydrogen stream; heating the hydroprocessing hydrogen stream and the second hydrogen stream before or after the taking step; hydrotreating a hydrocarbon feed stream in the presence of the hydroprocessing hydrogen stream and a hydrotreating catalyst to produce a hydrotreated stream; separating the hydrotreated stream in a hot separator to provide a vapor hydrotreated stream and a liquid hydrotreated stream; and hydrocracking the liquid hydrotreated stream in the presence of the second hydrogen stream and a hydrocracking catalyst to provide a hydrocracked stream. An embodiment of the invention is one, any or all of prior embodiments in this paragraph up through the first embodiment in this paragraph further comprising quenching the second hydrogen stream before the hydrocracking step with a quench hydrogen stream taken from the hydroprocessing hydrogen stream before the heating step. An embodiment of the invention is one, any or all of prior embodiments in this paragraph up through the first embodiment in this paragraph further comprising mixing the second hydrogen stream and the liquid hydrotreated stream before the quenching step. An embodiment of the invention is one, any or all of prior embodiments in this paragraph up through the first embodiment in this paragraph further comprising measuring the temperature of a hydrocracking feed stream that includes the liquid hydrotreated stream, comparing the measured the temperature against a set point temperature and adjusting the flow rate of the quench hydrogen stream based on the comparison. An embodiment of the invention is one, any or all of prior embodiments in this paragraph up through the first embodiment in this paragraph further comprising mixing the vapor hydrotreated stream with the hydrocracked stream to provide a hydroprocessed stream. An embodiment of the invention is one, any or all of prior embodiments in this paragraph up through the first embodiment in this paragraph further comprising separating the hydroprocessed stream into a vapor hydroprocessed stream and a liquid hydroprocessed stream. An embodiment of the invention is one, any or all of prior embodiments in this paragraph up through the first embodiment in this paragraph further comprising compressing at least a portion of the vapor hydroprocessed stream to provide the hydroprocessing hydrogen stream. An embodiment of the invention is one, any or all of prior embodiments in this paragraph up through the first embodiment in this paragraph further comprising fractionating at least a portion of the liquid hydroprocessed stream to provide a naphtha stream and a diesel stream. An embodiment of the invention is one, any or all of prior embodiments in this paragraph up through the first embodiment in this paragraph further comprising operating the hot separator at 340 to about 380° C. An embodiment of the invention is one, any or all of prior embodiments in this paragraph up through the first embodiment in this paragraph further comprising cooling the hydrotreated stream prior to entering the hot separator. An embodiment of the invention is one, any or all of prior embodiments in this paragraph up through the first embodiment in this paragraph wherein the hydrocarbon feed stream comprises at least 10 wt % diesel. An embodiment of the invention is one, any or all of prior embodiments in this paragraph up through the first embodiment in this paragraph further comprising mixing the hydroprocessing hydrogen stream and the hydrocarbon stream after the heating step. An embodiment of the invention is one, any or all of prior embodiments in this paragraph up through the first embodiment in this paragraph further comprising mixing the second hydrogen stream and the liquid hydrotreated stream before the hydrocracking step.

A second embodiment of the invention is a process comprising taking a hydroprocessing hydrogen stream and a second hydrogen stream from a hydroprocessing hydrogen stream; heating the hydroprocessing hydrogen stream and the second hydrogen stream before or after the taking step; mixing the hydroprocessing hydrogen stream and a hydrocarbon stream after the heating step; hydrotreating the hydrocarbon feed stream in the presence of the hydroprocessing hydrogen stream and a hydrotreating catalyst to produce a hydrotreated stream; separating the hydrotreated stream in a hot separator to provide a vapor hydrotreated stream and a liquid hydrotreated stream; mixing the second hydrogen stream and the liquid hydrotreated stream after the heating step; and hydrocracking the liquid hydrotreated stream in the presence of the second hydrogen stream to provide a hydrocracked stream. An embodiment of the invention is one, any or all of prior embodiments in this paragraph up through the second embodiment in this paragraph further comprising quenching the second hydrogen stream before the hydrocracking step with a quench hydrogen stream taken from the hydroprocessing hydrogen stream before the heating step. An embodiment of the invention is one, any or all of prior embodiments in this paragraph up through the second embodiment in this paragraph further comprising mixing the vapor hydrotreated stream with the hydrocracked stream to provide a hydroprocessed stream.

A third embodiment of the invention is an apparatus comprising a hydroprocessing hydrogen line; a heater in downstream communication with the hydroprocessing hydrogen line; a first hydrogen line in downstream communication with the heater; a second hydrogen line in downstream communication with the heater; a hydrotreating reactor in downstream communication with the first hydrogen line; a hot separator in downstream communication with the hydrotreating reactor; a hydrocracking reactor in downstream communication with a bottoms line of the separator and the second hydrogen line; a fractionation column in downstream communication with the hydrocracking reactor and an overhead line of the hot separator. An embodiment of the invention is one, any or all of prior embodiments in this paragraph up through the third embodiment in this paragraph further comprising a hydroprocessed line in downstream communication with the hydrocracking reactor and an overhead line of the hot separator. An embodiment of the invention is one, any or all of prior embodiments in this paragraph up through the third embodiment in this paragraph further comprising a cold separator in downstream communication with the hydrocracking effluent line and the hydroprocessing hydrogen line is in downstream communication with the cold separator. An embodiment of the invention is one, any or all of prior embodiments in this paragraph up through the third embodiment in this paragraph further comprising a hydrocracking feed line in downstream communication with the bottoms line of the hot separator, the second hydrogen line and the cold separator and the hydrocracking reactor is in downstream communication with the hydrocracking feed line.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A hydrocracking process comprising:

taking a hydroprocessing hydrogen stream and a second hydrogen stream from a hydroprocessing hydrogen stream;

heating the hydroprocessing hydrogen stream and the second hydrogen stream before or after the taking step;

hydrotreating a hydrocarbon feed stream in the presence of the hydroprocessing hydrogen stream and a hydrotreating catalyst to produce a hydrotreated stream;

separating said hydrotreated stream in a hot separator to provide a vapor hydrotreated stream and a liquid hydrotreated stream;

hydrocracking said liquid hydrotreated stream prior to any fractionation in the presence of the second hydrogen stream and a hydrocracking catalyst to provide a hydrocracked stream; and quenching the second hydrogen stream before the hydrocracking step with a quench hydrogen stream taken from said hydroprocessing hydrogen stream before the heating step.

2. The process of claim 1 further comprising mixing the second hydrogen stream and the liquid hydrotreated stream before the quenching step.

3. The process of claim 1 further comprising measuring the temperature of a hydrocracking feed stream that includes the liquid hydrotreated stream, comparing the measured the temperature against a set point temperature and adjusting the flow rate of the quench hydrogen stream based on the comparison.

4. The process of claim 1 further comprising mixing the vapor hydrotreated stream with the hydrocracked stream to provide a hydroprocessed stream.

5. The process of claim 4 further comprising separating said hydroprocessed stream into a vapor hydroprocessed stream and a liquid hydroprocessed stream.

6. The process of claim 5 further comprising compressing at least a portion of said vapor hydroprocessed stream to provide said hydroprocessing hydrogen stream.

7. The process of claim 5 further comprising fractionating at least a portion of said liquid hydroprocessed stream to provide a naphtha stream and a diesel stream.

8. The process of claim 1 further comprising operating the hot separator at a temperature of about 340 to about 380° C.

9. The process of claim 4 further comprising cooling the hydrotreated stream prior to entering the hot separator.

10. The process of claim 1 wherein said hydrocarbon feed stream comprises at least 10 wt % diesel.

11. The process of claim 1 further comprising mixing the hydroprocessing hydrogen stream and the hydrocarbon stream after the heating step.

12. The process of claim 1 further comprising mixing the second hydrogen stream and the liquid hydrotreated stream before the hydrocracking step.

13. A hydrocracking process comprising:

taking a hydroprocessing hydrogen stream and a second hydrogen stream from a hydroprocessing hydrogen stream;

heating the hydroprocessing hydrogen stream and the second hydrogen stream before or after the taking step;

mixing the hydroprocessing hydrogen stream and a hydrocarbon stream after the heating step;

hydrotreating the hydrocarbon feed stream in the presence of the hydroprocessing hydrogen stream and a hydrotreating catalyst to produce a hydrotreated stream;

separating said hydrotreated stream in a hot separator to provide a vapor hydrotreated stream and a liquid hydrotreated stream;

mixing the second hydrogen stream and the liquid hydrotreated stream after the heating step;

hydrocracking said liquid hydrotreated stream in the presence of the second hydrogen stream to provide a hydrocracked stream; and quenching the second hydrogen stream before the hydrocracking step with a quench hydrogen stream taken from said hydroprocessing hydrogen stream before the heating step.

14. The process of claim 13 further comprising mixing the vapor hydrotreated stream with the hydrocracked stream to provide a hydroprocessed stream.

* * * * *